United States Patent [19]

Ruhl

[11] Patent Number: 4,541,369

[45] Date of Patent: Sep. 17, 1985

[54] COOLING APPARATUS FOR COMBUSTION ENGINE

[75] Inventor: Thomas Ruhl, Stuttgart, Fed. Rep. of Germany

[73] Assignee: Daimler-Benz Aktiengesellschaft, Stuttgart, Fed. Rep. of Germany

[21] Appl. No.: 600,815

[22] Filed: Apr. 16, 1984

[30] Foreign Application Priority Data

Apr. 28, 1983 [DE] Fed. Rep. of Germany ..... 3315343

[51] Int. Cl.[4] ..... F01P 5/06

[52] U.S. Cl. ..... 123/41.49; 416/190

[58] Field of Search ..... 123/41.46, 41.48, 41.49, 123/41.65, 41.66; 416/189 R, 190; 415/207, 219 R, DIG. 1

[56] References Cited

U.S. PATENT DOCUMENTS

| | | | |
|---|---|---|---|
| 2,668,523 | 2/1954 | Lamb | 123/41.49 |
| 3,144,859 | 8/1964 | Walton | 415/219 R |
| 3,794,001 | 2/1974 | Birch et al. | 415/219 R |
| 4,131,156 | 12/1978 | Crumrine, Jr. et al. | 415/219 R |

*Primary Examiner*—William A. Cuchlinski, Jr.
*Attorney, Agent, or Firm*—Barnes & Thornburg

[57] ABSTRACT

An air guide ring arrangement is disclosed for guiding air flow around an axial fan of a liquid cooled internal combustion engine having a radiator through which air is drawn by the fan. To facilitate construction of a minimal sized air gap between the air guide ring and the fan blades, the air guide ring is supported by a gibbet or bracket arm fixed to the engine and by a spoked support wheel rotatably borne at the outer circumference of the fan hub.

11 Claims, 1 Drawing Figure

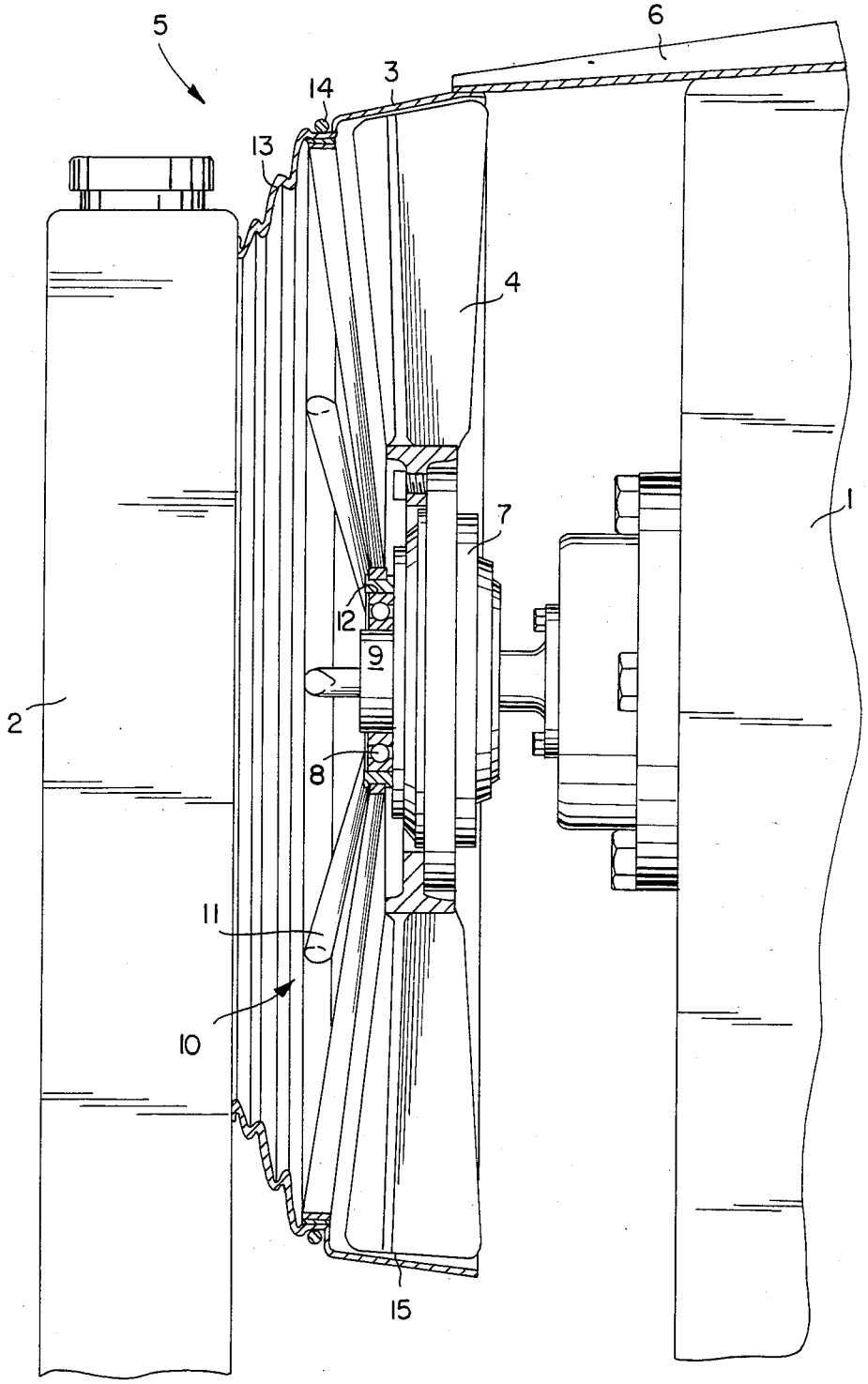
5
6
3
14
13
4
7
1
12
9
2
8
11
10
15

COOLING APPARATUS FOR COMBUSTION ENGINE

BACKGROUND AND SUMMARY OF THE INVENTION

The invention relates to a cooling arrangement, especially for a liquid cooled internal combustion engine of the type having a liquid/air heat exchanger or radiator and an engine driven blower fan for drawing air through the heat exchanger in the direction toward the engine. The invention is more particularly related to such an arrangement which includes a flexible air guide ring for guiding the flow of air from the heat exchanger and around and through the blower fan.

A blower or fan for the radiator of a motor vehicle is known from German Published Application (DE-OS) No. 29 24 568 which has a fan ring supported by a spoked wheel and surrounded by an air flow ring resulting in an air gap therebetween. A hollow axle fixedly attached to the internal combustion engine is provided for supporting a drive wheel, the blower wheel and the spoked wheel. The radiator and the air flow ring are connected to each other by means of bellows forming an air pocket. This arrangement exhibits disadvantages in that the weight of the fan ring and the spoked wheel upon hollow axles supporting the drive wheel and fan wheel influences the functioning of same so that a satisfactory reliable operation cannot be achieved.

Furthermore, an internal combustion engine with a cooling system is known from U.S. Pat. No. 2,668,523 featuring an axial fan surrounded by an air duct ring. The air duct ring is fixedly attached by means of gibbets to the internal combustion engine and a wind pocket is attained through utilization of an elastic rubber bellows attached to the air guide ring and the radiator. However, this arrangement exhibits a disadvantage in that the air gap between the axial fan and the air guide ring cannot be maintained sufficiently small enough to prevent the axial fan from hitting against the air guide ring due to imbalance movements of the axial fan in radial directions and due to vibratory movements of the air guide ring transmitted during operation of the internal combustion engine.

It is an object of this invention to provide a cooling device arrangement which not only achieves the smallest possible air gap between the axial fan and the air guide ring, but for the most part eliminates the pressure upon the bearing of the axial fan caused by the weight of the fan rings and the spoked support wheel.

The above-mentioned problems with the prior art are solved by the present invention by providing that the air guide ring is supported by at least one rigid support bracket attached to the engine and by a spoked support wheel rotatably borne at the circumference of the hub of the fan axle.

In especially preferred embodiments of the invention, the spoked support wheel is connected to the fan axle hub by means of a vulcanized rubber connection of U-shaped cross section at the outer race of a roller bearing carried at the hub. Preferred embodiments also include a glued connection of the flexible air guide ring at the radiator and a circumferential tension ring connection of the air guide ring at the spoked support wheel. To reduce air flow resistance the spokes of the air guide ring are formed with a droplet shaped cross-section in especially preferred embodiments.

Further features of an especially preferred embodiment include the construction of the hub as a housing for a visco-coupling for the blower fan, a cover plate part of the hub housing at the side facing the heat exchanger including an extension which accommodates the inner race of the roller bearing for the spoked support wheel.

The cooling device arrangement in accordance with the present invention features the advantage that the weight of the air guide ring and the spoked support wheel is eased by the gibbet or support arm bracket fixedly attached to the internal cumbustion engine. The spoked support wheel supporting itself upon the roller bearing essentially centers or aligns the air guide ring with respect to the axial fan so that if the operation of the fan becomes eccentric, the eccentricity is transformed to the air guide ring by means of the spoked wheel. This feature first allows the construction of a cooling device which is provided with a rather small air gap between the axial fan and the air guide ring. Furthermore, central forces that occur in the axial direction may, for example, as they influence the spoked wheel during the acceleration process of a motor vehicle, be transferred to the bearing support.

Further objects, features, and advantages of the present invention will become more apparent from the following description when taken with the accompanying drawing which show, for purposes of illustration only, embodiments in accordance with the present invention.

BRIEF DESCRIPTION OF THE DRAWINGS

The single drawing FIGURE is a partial schematic, part-sectional view showing a preferred embodiment of the present invention.

DETAILED DESCRIPTION OF THE DRAWINGS

An internal combustion engine 1 includes a cooling device 5 having a heat exchanger 2 and an axial blower fan 4, said fan 4 being surounded by an air guide ring 3, said ring 3 being fixedly attached to the internal combustion engine 1 by means of a gibbet 6 or supporting arm bracket. A hub, arranged at the internal combustion engine 1 and holding the axial fan 4 is provided as a visco-coupling housing and includes a bearing connection to the engine drive axle which bearing connection is not further described. A cover plate disposed at the axial fan 4 at the side of the air intake, exhibits a shell like extension 9 to accommodate a roller bearing 8. A spoked wheel 10 having a droplet-shaped cross section of spokes 11 supports itself upon a vulcanized rubber connection 12 of the roller bearing 8, said rubber connection 12 having a U-shaped cross section. A flexible rubber bellows 13 is provided which connects the heat exchanger 2 and the air guide ring 3 and is glued to the heat exchanger 2 while at the same time being detachably attached to the air guide ring 3 by means of a circumferential tension ring 14.

During operation of the axial fan 4, the radial oscillating or vibratory movements of the axial fan axle that occur are dampened by means of the vulcanized rubber connection 12 of the roller bearing 8 and are transmitted via the spoked wheel 10 to the air guide ring 3.

Any change in positioning of the internal combustion engine and therewith also of the axial fan 4 are conveyed to the air guide ring 3.

Any changes in positioning of the internal combustion engine and therewith also of the axial fan 4 are conveyed to the air guide ring 3 by means of the spoked wheel 10, and a constant air gap 15 between the axial fan 4 and the air guide ring 3 is thereby guaranteed.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Cooling apparatus for liquid cooled internal combustion engine and the like, comprising:

a heat exchanger;

an internal combustion engine;

an axial blower fan drivingly connected to the engine and disposed between the engine and the heat exchanger, said blower fan having an axle fan blade extending radially from the axle and with a centrally disposed hub means; and an air guide ring for guiding air flow around the periphery of the fan blades, wherein said air guide ring is supported in position by at least one support bracket arm attached to the engine and spoked support wheel means rotatably connected to the outer circumference of the hub means, and wherein the spoked support wheel means is supported at the hub means by roller bearing means and vulcanized rubber at the periphery of the roller bearing.

2. Apparatus according to claim 1, wherein the vulcanized rubber at the side opposite the roller bearing means exhibits a U-shaped cross-section.

3. Apparatus according to claim 1, wherein the air guide ring is formed of a relatively rigid annular collar.

4. Apparatus according to claim 3, wherein a flexible bellows connects the heat exchanger and the air guide ring, said flexible bellows being glued to the heat exchanger.

5. Apparatus according to claim 3, wherein the spokes of the spoked support wheel means exhibit a droplet-shaped cross-section to minimize air flow resistance thereby.

6. Apparatus according to claim 3, wherein the flexible bellows is connected to the air guide ring by means of a tension ring encircling and clamping overlapping portions of the air guide ring and the flexible bellows.

7. Apparatus according to claim 1, wherein the hub means forms a housing for a visco-coupling for the blower fan, and wherein a cover plate part of the hub means at the side facing the heat exchanger exhibits a shell shaped extension for accommodating roller bearing means of the spoked support shell means at the outer periphery thereof.

8. Apparatus according to claim 7, wherein the vulcanized rubber at the side opposite the roller bearing means exhibits a U-shaped cross-section.

9. Cooling apparatus for liquid cooled internal combustion engine and the like, comprising:

a heat exchanger;

an internal combustion engine;

an axial blower fan drivingly connected to the engine and disposed between the engine and the heat exchanger, said blower fan having an axle fan blade extending radially from the axle and with a centrally disposed hub means; and an air guide ring for guiding air flow around the periphery of the fan blades, wherein said air guide ring is supported in position by at least one support bracket arm attached to the engine and spoked support wheel means rotatably connected to the outer circumference of the hub means, and wherein the hub means forms a housing for a visco-coupling for the blower fan, and wherein a cover plate part of the hub means at the side facing the heat exchanger exhibits a shell shaped extension for accommodating roller bearing means of the spoked support shell means at the outer periphery thereof.

10. Apparatus according to claim 9, wherein the air guide ring is formed of a relatively rigid annular collar.

11. Apparatus according to claim 10, wherein a flexible bellows connects the heat exchanger and the air guide ring, said flexible bellows being glued to the heat exchanger.

* * * * *